US007301087B2

(12) United States Patent
Takegawa

(10) Patent No.: US 7,301,087 B2
(45) Date of Patent: Nov. 27, 2007

(54) LOW FRICTION SYSTEM FOR SNARE DRUM TENSION ADJUSTER

(75) Inventor: Akito Takegawa, Chiba (JP)

(73) Assignee: Pearl Musical Instrument Co., Chiba (JP)

( * ) Notice: Subject to any disclaimer, the term of this patent is extended or adjusted under 35 U.S.C. 154(b) by 126 days.

(21) Appl. No.: 11/090,889

(22) Filed: Mar. 25, 2005

(65) Prior Publication Data

US 2006/0213353 A1 Sep. 28, 2006

(51) Int. Cl.
*G10D 3/00* (2006.01)

(52) U.S. Cl. ..... 84/411 R

(58) Field of Classification Search ..... 84/421, 84/411 R, 415–417
See application file for complete search history.

(56) References Cited

U.S. PATENT DOCUMENTS 5,557,053 A 9/1996 Nickel 6,846,978 B2 * 1/2005 Dorfman et al. ..... 84/415

* cited by examiner

*Primary Examiner*—Kimberly Lockett
(74) *Attorney, Agent, or Firm*—Berenato, White & Stavish

(57) ABSTRACT

A tensioning system for a snare assembly adapted to be attached to a percussion instrument, comprising a main body adapted to be fixedly mounted to the percussion instrument; a snare fastener assembly for fastening snares with respect to the main body; and a pivotable or rotatable tension adjuster mounted with respect to the main body and the snare fastener. Pivoting or rotating the tension adjuster changes a position of said snare fastener to change tension of said snares. A bearing assembly, preferably in the form of roller bearings or low-friction plates, is interposed between the slider/piston member and the main body of the snare tensioning system to reduce play and vibration between the slider/piston member and the main body mounted to the percussion instrument.

11 Claims, 4 Drawing Sheets

Fig. 1b
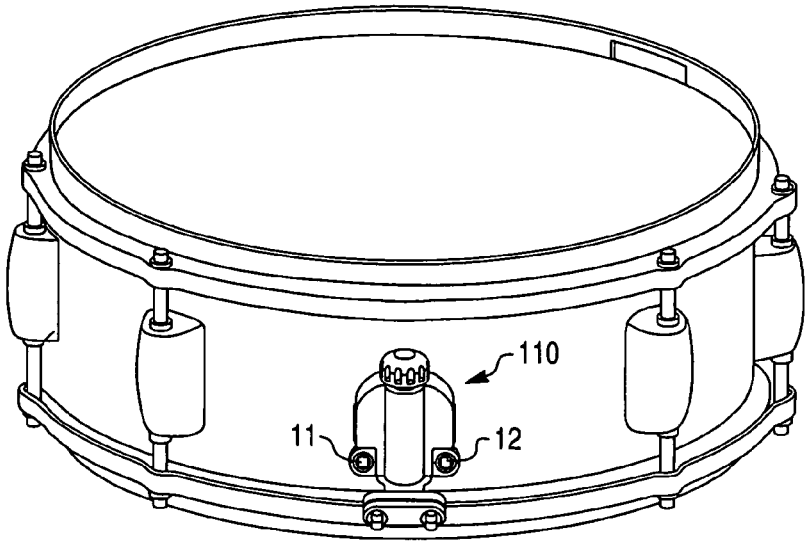
Fig. 5
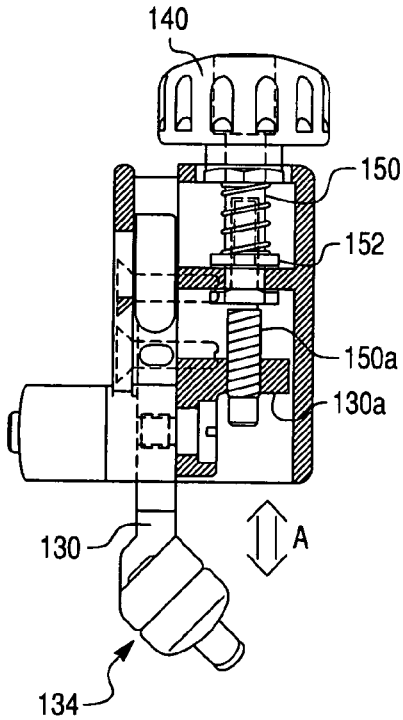
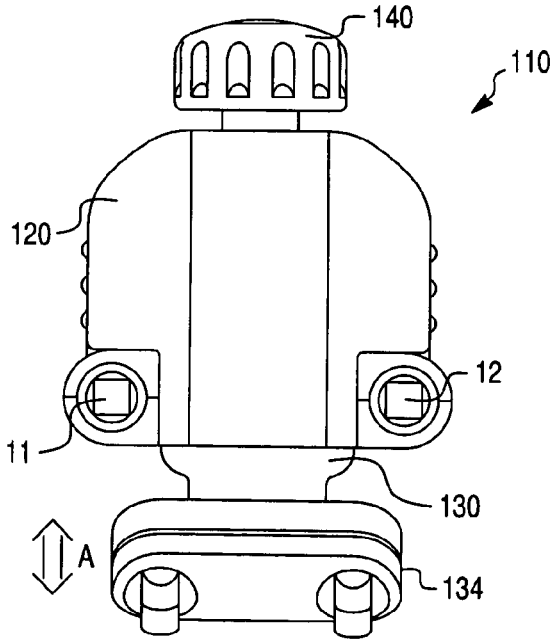
Fig. 4

LOW FRICTION SYSTEM FOR SNARE DRUM TENSION ADJUSTER

BACKGROUND OF THE INVENTION

1. Field of the Invention

The present invention is directed to a snare tensioner and/or adjuster for use with a snare drum, in particular to a variable snare tension system including an improved low-friction slider assembly.

2. Description of the Related Art

Snare drums typically include a plurality of wires, or snares, which contact a bottom drumhead of the snare drum so that the snares are vibrated by the vibration of the bottom drumhead when the snare drum is played. A strainer is typically used to tension the snares in order to change the tone produced by the drum by changing the position of the snares so that they are either in contact or not in contact with the drumhead.

Conventional strainers for snares use a lever directly connected to a piston, wherein the lever pivots about an axis generally perpendicular to the piston, so that when the lever is pivoted from one position to another, the piston drops and the tension in the snares is released so that the snares are no longer in contact with the drumhead. Some of these pivoting lever for strainers can only be operated so that the snares are either in contact with the drumhead (snares-on mode), or not in contact with the drumhead (snares-off mode), and are not adjustable to different tensions in between. Further, the strainer tends to be tensioned or released quickly, so that the snares make an unwanted "throw-off" noise against the drumhead, which is very undesirable, particularly for orchestral musicians. Other prior art systems permit intermediate adjustment of the snare tension between the snare-on and snare-off modes using the strainer.

Snare tension may also be fine tuned or finely adjusted by a tensioner system, usually with a turnable knob which is rotated to finely tune the tension in the snare to change the tone produced by the drum.

However, the throw-off lever systems and tension knob systems in the prior art strainers typically rattle or vibrate during use because of manufacturing tolerances and gaps that exist between the slider/piston member and the main body. As a result, the snare tensioning systems are less durable and generate unwanted noise and vibration during use.

The need exists for a system and assembly for various snare tensioning systems to prevent rattle, vibration, noise or slippage between the slide/piston member and the main body during performance or play.

SUMMARY OF THE INVENTION

The invention provides a tensioning system for a snare assembly adapted to be attached to a percussion instrument, comprising a main body adapted to be fixedly mounted to the percussion instrument; a snare fastener assembly for fastening snares with respect to the main body; and a pivotable or rotatable tension adjuster mounted with respect to the main body and the snare fastener. Pivoting or rotating the tension adjuster changes a position of said snare fastener to change tension of said snares. A low-friction bearing system is interposed between the slider/piston member and the main body of the snare tensioning system to reduce play and vibration between the slider/piston member and the main body mounted to the percussion instrument.

In the preferred embodiments, the low-friction bearing system may include either a series of ball bearings or at least one low-friction plate disposed between the movable slider/piston member and the main body, whereby the slider/piston member slides relative to the main body to change the tension in the snares.

These and other structural and functional benefits of the present invention will be apparent to those of skill in the art when viewed in light of the following description and the accompanying drawings.

BRIEF DESCRIPTION OF THE DRAWINGS

FIGS. 1*a* and 1*b* are perspective views of the snare drum and snare tensioner systems of this present invention.

FIG. 4 is a front view of the tensioner according to the present invention.

FIG. 5 is a partial cross sectional view of the tensioner of FIG. 4 showing the internal piston member and tension nut system.

DETAILED DESCRIPTION OF PREFERRED EMBODIMENT

Figure 1A:
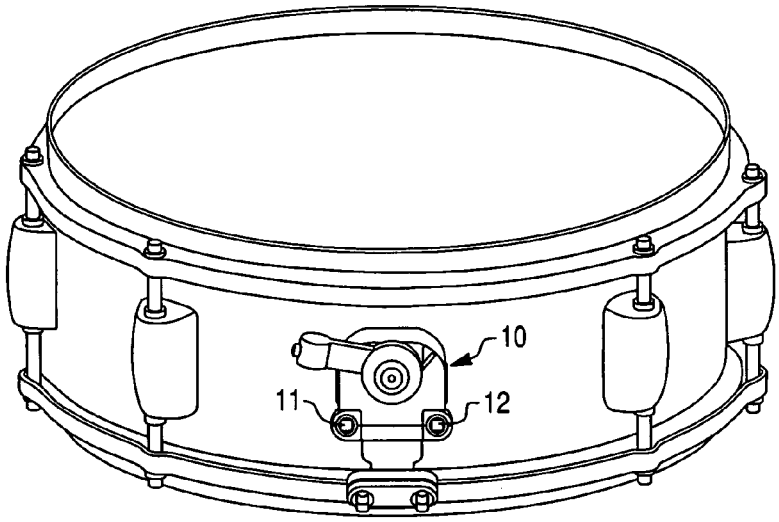

With reference to FIGS. 1*a* and 1*b*, the throw-off tension adjuster 10 and rotary tension adjuster 110 of this invention are respectively shown mounted to a docking station (not shown) bolted to the drum shell. Attachment bolts 11, 12 preferably have a drum key head thus making the throw-off adjuster 10 or rotary adjuster 110 easy to remove with a conventional drum key with the strings and snares still attached to the adjusters 10, 110. This allows the bottom head of the drum to be changed without upsetting the setting of the snares. After the bottom head of the drum is replaced, the tension adjusters 10, 110 can be reattached to the drum and the snares will be perfectly set and aligned as before removal.

Figure 2:
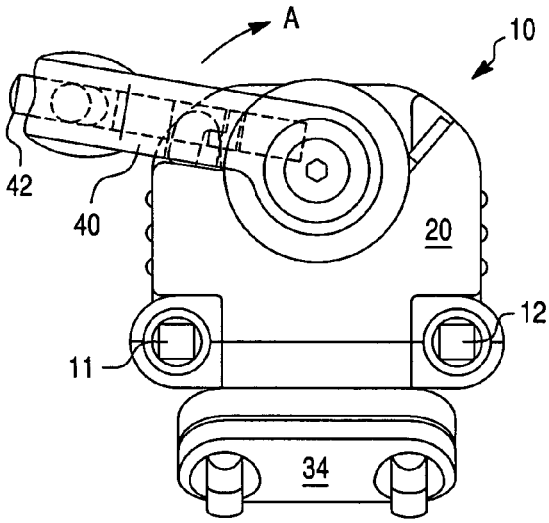
FIG. 2 is a front view of the strainer according to the present invention shown in the snare-on position.
Figure 3:
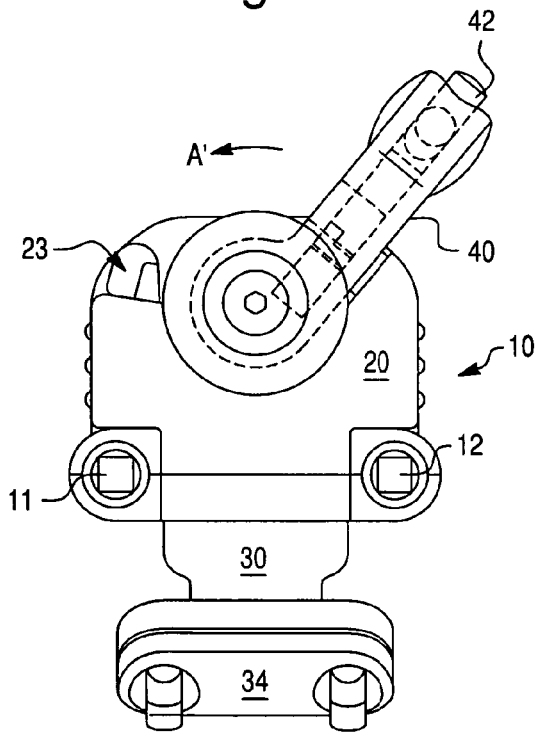
FIG. 3 is a front view of the strainer according to the present invention shown in the snare-off position.

The throw-off tension adjuster 10 is shown in an isolated drawing in FIGS. 2 and 3. FIG. 2 shows the strainer 10 in a snare-on position, and FIG. 3 shows the strainer 10 in the snare-off position. The strainer 10 comprises a main body 20 mountable to the drum shell through attachment bolts 11, 12; a piston member 30 sandwiched between two shell members of the main body 20; and a lever 40 that is cammingly engageable with the piston member 30. Thus, the piston 30 is retained within the main body 20 connected to the shell so that the piston member 30 may reciprocate relative to the shell. As the lever 40 is pivoted in the direction of arrow A' the piston member 30 will move in a downward direction and, as a result, the snare clamp 34 moves to adjust the tension on the snares.

The rotary tension adjuster 110 of FIG. 1B is shown in an isolated drawing in FIG. 4. The rotary tension adjuster 110 comprises a main body 120 mountable to the drum shell through attachment bolts 11, 12; a piston member 130 mounted to the main body 120; a rotary adjustment knob 140; and tension nut system (not shown) that is threaded to the piston member 130 to deliver torque from the tension knob 140 to fine tune the position of the piston member 130. Thus, the piston 130 is retained within the main body 120 connected to the shell so that the piston member 130 may reciprocate relative to the shell. As the tension knob 140 is rotated, the piston member 30 will selectively move up and down in the direction of arrow 'A' and, as a result, the snare clamp 134 moves to adjust the tension on the snares. Typically, snares are operably connected to piston member 130 by the snare clamp 134 in a manner that is well known to those of skill in the art.

FIG. 5 shows the tension nut system that transforms rotary torque from the tension knob 140 to linear movement of the piston member 130. The tension nut system comprises a screw member 150 that is fixed to rotate with the tension knob 140. The screw member 150 passes through a bearing member 152 and threadingly engages a leg portion 130*a* of the piston member 130 at a lower threaded region 150*a*. The bearing member 152 is fitted onto the screw member 150 to permit rotational movement of the screw member 150 while preventing axial movement of the screw member 150. When the tension knob 140 and screw member 150 are permitted to rotate relative to the housing 120, the piston member 130 will translate in the direction of arrow 'A' (FIGS. 4 and 5) at a rate defined by the threads of the threaded region 150*a*.

Figure 6:
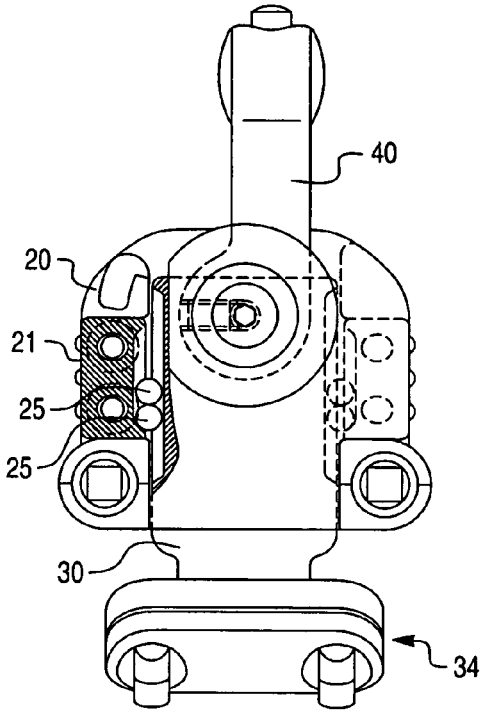
FIG. 6 is a partial cross sectional view of the throw-off tension adjuster of FIGS. 2 and 3 showing a first embodiment of the bearing system of this invention.
Figure 7:
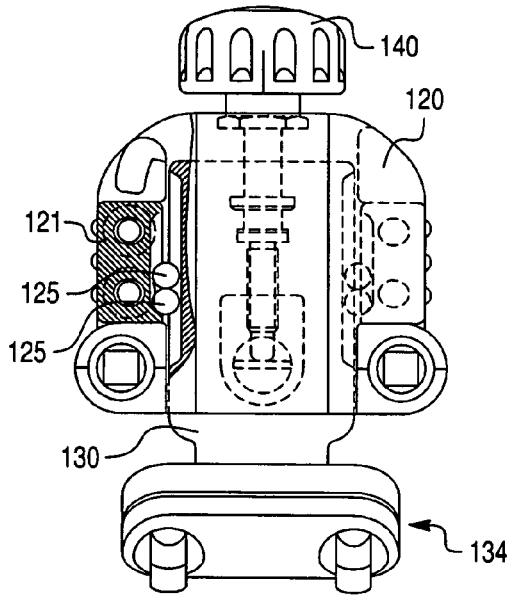
FIG. 7 is a partial cross sectional view of the rotary tension adjuster shown in FIG. 4 showing a first embodiment of the bearing system of this invention.
Figure 9:
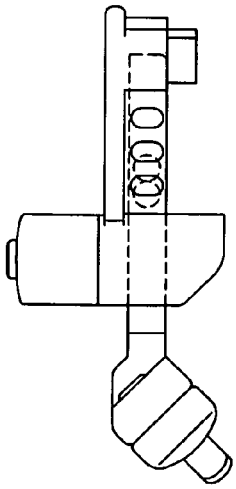
FIG. 9 is a cross sectional view of the main body and slider/piston shown in FIG. 8.
Figure 8:
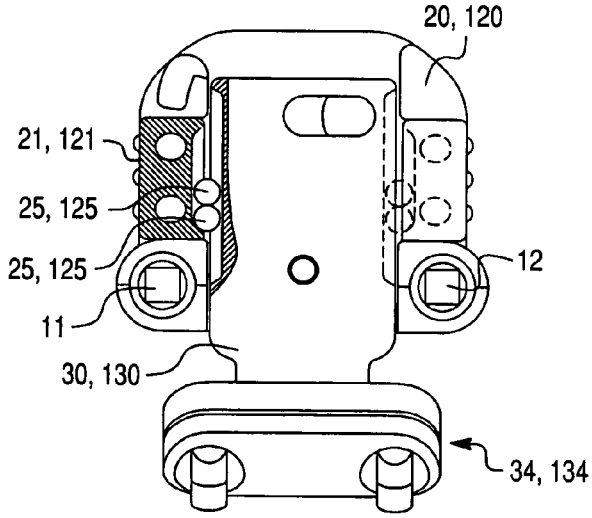
FIG. 8 is a partial cross sectional view of the main body and slider/piston shown in FIGS. 2, 3 and 6 showing a modification where a best mode of two roller bearing members are employed.

FIGS. 6 and 7 are partial cross sectional view of a first embodiment of the tensioner systems of FIGS. 1-5. FIGS. 6 and 7 show the piston member 30, 130 and main body 20, 120 with bearing members 25, 125 in the form of steel balls disposed between the main body 20, 120 and the piston member 30, 130. The bearing members 25, 125 reduce side-by-play of the piston member 30, 130 and provide a smoother camming action and sliding action during use. The side portions of the piston member 30, 130 and the main body 20, 120, which face each other, are slightly recessed to provide a bearing pocket to receive and house the bearing members 25, 125 through a limited range of motion of the piston member 30, 130 with respect to the main body 20, 120. Although two ball bearings 25, 125 are shown on each side of the piston member 30, 130, any suitable number of bearing may be used. FIGS. 8 and 9 shows a simplified illustration of the first embodiment of the roller bearing system where two roller bearings, instead of three or four, are employed as the best mode of the invention.

Figure 10:
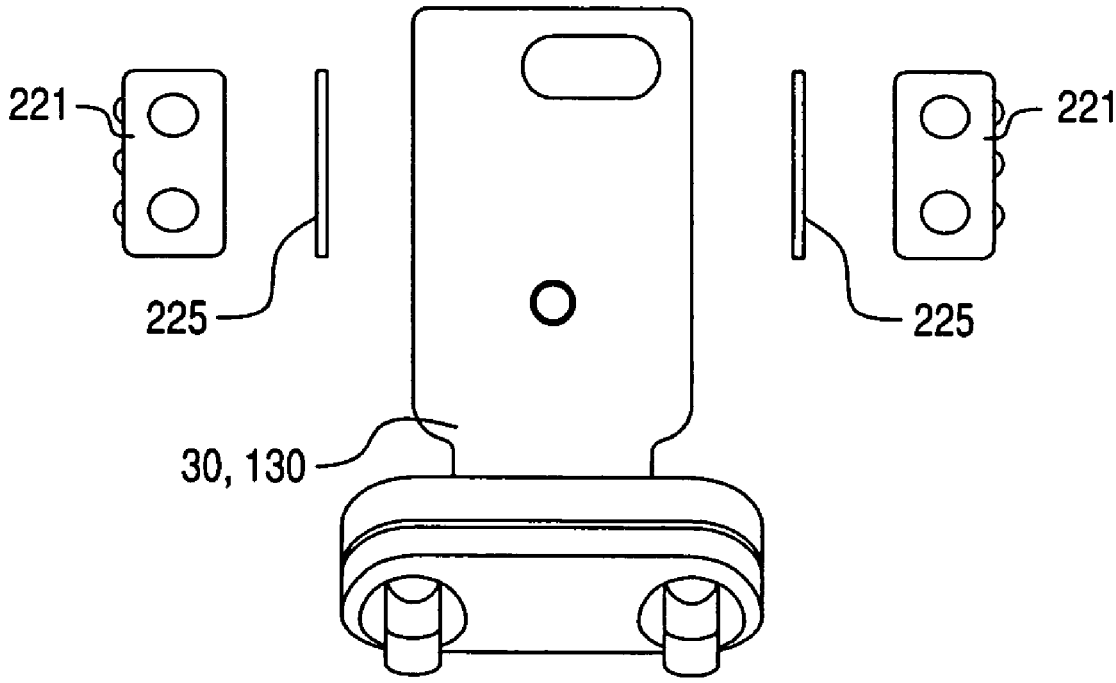
FIG. 10 shows an alternate embodiment of the bearing system of this invention where a pair of low-friction plates is disposed between the main body and the piston member.

FIG. 10 shows an alternate embodiment of the bearing system of this invention where a pair of low-friction plates 225 is disposed between the main body 20, 120 and the piston member 30, 130. The low-friction plates 225 reduce side-by-play of the piston member 30, 130 and provide a smoother camming action and sliding action during use. In the preferred mode of this second embodiment, at least two low-friction plastic plates 225 are used as the plates and are sized and dimensioned to reduce a frictional interface between the main body 20, 120 and the piston member 30, 130.

Further, the present invention may define a main body 20, 120 having a removable/replaceable sidewall members 21, 121, 221 such that the sidewall member 21, 121, 221 may be removed and replaced to accommodate either the ball bearing members 25, 125 (see FIG. 8) or the low-friction plates 225 (see FIG. 10). The modular sidewall arrangement improves the versatility and effectiveness of the present invention. As shown in FIG. 8, the sidewall members 21, 121 are formed with a recess pocket to accommodate the roller bearings 25, 125. As shown in FIG. 10, the sidewall members 221 are formed with flat inner sidewalls, instead of recessed pockets, to accommodate the flat, low-friction plates 225.

Further, the sidewall member 21, 121, 221 may be adjusted and can be set with a varying degree of pressure to adjust the play of the piston member 30, 130 from virtually no play (i.e., tighter action) to more play (i.e., looser action). The factory default may be set to optimize low play and smooth action; however, the setting can be tightened or loosened by the player. Adjustment is accomplished by loosening the screws on the back of the throwoff/adjustment side and pressing the sidewall members 21, 121, 221 toward the piston member 30, 130 with the desired pressure. Then, the set screws re tightened to maintain the setting against either the ball bearing members 25, 125 (see FIG. 8) or the low-friction plates 225 (see FIG. 10).

While the present invention has been shown and described with respect to various preferred embodiments of snare tensioners, it will be understood by those of skill in the art that other changes in form and detail may be made to the preferred embodiments described herein without departing from the spirit and scope of this invention. For example, the specification and function of the bearing system may be modified to accommodate requirements for the tension adjuster system beyond the specific ball bearings and low-friction plates shown and described above.

The invention claimed is:

1. A tensioner system for a snare assembly adapted to be attached to a percussion instrument, said tensioner system comprising:

a main body adapted to be fixedly mounted to the percussion instrument;

a movable snare fastener assembly for fastening snares with respect to said main body;

a tension adjuster mounted with respect to said main body, whereby said tension adjuster changes a position of said snare fastener to selectively change tension of said snares; and a plurality of rolling ball bearings interposed between said main body and a piston member to reduce play therebetween.

2. The tensioner system recited in claim 1, wherein said plurality of rolling ball bearings include at least two roller bearings on opposite sides of said piston member.

3. A tensioner system for a snare assembly adapted to be attached to a percussion instrument, said tensioner system comprising:

a main body adapted to be fixedly mounted to the percussion instrument;

a movable snare fastener assembly for fastening snares with respect to said main body;

a tension adjuster mounted with respect to said main body, whereby said tension adjuster changes a position of said snare fastener to selectively change tension of said snares; and a bearing system interposed between said main body and a piston member to reduce play therebetween, wherein said bearing system comprises at least one low-friction plate having a coefficient of friction that is lower than said main body and said piston member.

4. The tensioner system recited in claim 3, wherein said at least one low-friction plate comprises at least one low-friction plastic plate.

5. The tensioner system recited in claim 1, wherein at least one of said main body and said piston comprises a recessed portion defining a bearing pocket receiving said plurality of roller bearings therein.

6. The tensioner system recited in claim 1, wherein said plurality of rolling ball bearings contact both said main body and said piston member, said plurality of rolling ball bearings moving with respect to both said main body and said piston member.

7. A tensioner system for a snare assembly adapted to be attached to a percussion instrument, said tensioner system comprising:

a main body adapted to be fixedly mounted to the percussion instrument;

a movable snare fastener assembly for fastening snares with respect to said main body;

a tension adjuster mounted with respect to said main body, whereby said tension adjuster changes a position of said snare fastener to selectively change tension of said snares; and a bearing system interposed between said main body and a piston member to reduce play therebetween, wherein said main body comprises a movable sidewall member having a profile that matches a configuration of said bearing system.

8. The tensioner system recited in claim 7, wherein said movable sidewall member defines a recessed inside wall that matches a configuration of a bearing member of said bearing system.

9. The tensioner system recited in claim 7, wherein a position of said movable sidewall member may be adjusted to adjust a degree of pressure applied to said piston member.

10. A tensioner system for a snare assembly adapted to be attached to a percussion instrument, said tensioner system comprising:

a main body adapted to be fixedly mounted to the percussion instrument;

a snare fastener assembly for fastening snares with respect to said main body; said snare fastener assembly comprising a sliding piston member that translates with respect to said main body; and a bearing means interposed between said main body and said sliding piston member to reduce play therebetween comprising at least one low-friction plate having a coefficient of friction that is lower than said main body and said sliding piston member.

11. The strainer recited in claim 10, wherein said at least one low-friction plate comprises at least one low-friction plastic plate.

* * * * *